US006498429B1

(12) United States Patent
Sneider et al.

(10) Patent No.: US 6,498,429 B1
(45) Date of Patent: Dec. 24, 2002

(54) SODIUM-XENON LAMP WITH IMPROVED CHARACTERISTICS AT END-OF-LIFE

(75) Inventors: János Sneider, Hungary (HU); Jack Mack Strok, Garrettsville, OH (US); Zoltán Tóth, Hungary (HU); István Csányi, Hungary (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/439,700

(22) Filed: Nov. 15, 1999

(51) Int. Cl.[7] ..... H01J 17/20; H01J 61/12; H01J 61/16

(52) U.S. Cl. ..... 313/576; 313/638; 313/643; 313/570; 313/572

(58) Field of Search ..... 313/576, 112, 313/184, 220, 221, 227, 25, 601, 603, 619, 642, 643; 315/248, 246, 363, 637, 638

(56) References Cited

U.S. PATENT DOCUMENTS

| | | | | |
|---|---|---|---|---|
| 3,248,590 A | | 4/1966 | Schmidt | |
| 3,521,108 A | | 7/1970 | Hanneman | |
| 3,662,203 A | * | 5/1972 | Kuhl et al. | 313/25 |
| 4,146,813 A | | 3/1979 | van Vliet | |
| 5,434,473 A | | 7/1995 | Márton | |
| 5,814,944 A | | 9/1998 | Saito et al. | |
| 6,069,456 A | * | 5/2000 | Fromm et al. | 315/248 |

FOREIGN PATENT DOCUMENTS

| | | | | |
|---|---|---|---|---|
| RU | 2011241 C1 | * | 4/1994 | H01J/61/22 |
| WO | WO 98/25294 | | 6/1998 | |
| WO | WO 99/05699 | | 2/1999 | |

* cited by examiner

*Primary Examiner*—Michael H. Day
*Assistant Examiner*—Mariceli Santiago
(74) *Attorney, Agent, or Firm*—Fay, Sharpe, Fagan, Minnich & McKee, LLP

(57) ABSTRACT

A mercury-free high pressure sodium vapor lamp is dosed with sodium, xenon and zinc as an elemental metal additive. The addition of the metal additive prevents an undesirable low-voltage operating mode of the sodium-xenon discharge associated with a mercury-free HPS lamp, which otherwise occurs when sodium is no longer available to participate in the arc discharge.

16 Claims, 7 Drawing Sheets

SODIUM-XENON LAMP WITH IMPROVED CHARACTERISTICS AT END-OF-LIFE

BACKGROUND OF THE INVENTION

1. Field of the Invention

This invention pertains to high pressure sodium vapor lamps. More particularly, the invention relates to a mercury-free high pressure sodium vapor lamp, which is dosed with sodium, xenon and elemental zinc to prevent an undesirable low-voltage operating mode at end-of-life.

2. Discussion of the Art

Traditional arc-discharge high pressure sodium ("HPS") vapor lamps are described in U.S. Pat. No. 3,248,590 to Schmidt, entitled "High Pressure Sodium Vapor Lamp." These lamps utilize a slender, tubular envelope of light-transmissive refractory oxide material resistant to sodium at high temperatures, suitably high-density polycrystalline alumina or synthetic sapphire. The filling has traditionally comprised sodium along with a rare gas such as xenon to facilitate starting and mercury for improved efficiency. The ends of the alumina tube are sealed by suitable closure members affording connection to thermionic electrodes which may comprise a refractory metal structure activated by electron emissive material. The ceramic arc tube is generally supported within an outer vitreous envelope or jacket provided at one end with the usual screw base. The electrodes of the arc tube are connected to the terminals of the base, that is to shell and center contact, and the inter-envelope space is usually evacuated in order to conserve heat.

New environmental standards have necessitated that mercury be eliminated from the traditional arc-discharge HPS lamp design. These new designs are dosed only with sodium and xenon. Accordingly, as sodium is "lost" by chemical reactions or diffusion, the voltage decreases markedly. The resultant low voltage mode is characteristic of a xenon discharge. Low voltage operation at end-of-life is very undesirable, resulting in an overheated ballast, which gives rise to reduced ballast life.

SUMMARY OF THE INVENTION

There is a particular need for a mercury-free high pressure sodium lamp, which maintains lamp voltage within established operating limits thereby ensuring that the lamp does not cycle (from high voltage) and the ballast is not overheated (from low voltage) at the end-of-life.

Briefly, in accordance with one embodiment of the present invention, a new and improved mercury-free high pressure sodium lamp is provided. The lamp is designed to prevent an undesirable low-voltage operating mode of the sodium-xenon discharge, which otherwise occurs when sodium is no longer available to participate in the arc discharge. The end-of-life operating voltage designed into the mercury-free HPS lamp is configured to be within a range acceptable to the ballast in accordance with established ANSI/IEC standards.

A principal advantage of the present invention is that an undesirable low-voltage operating mode of a sodium-xenon discharge associated with a mercury-free HPS lamp is prevented.

Another advantage of the present invention is that the end-of-life operating voltage for a mercury-free HPS lamp falls within a range acceptable to established ANSI/IEC standards.

Still another advantage of the present invention is that mercury-free HPS lamps can be produced in a normal product line without significant equipment changes or increase in lamp variable cost.

Still a further advantage of the present invention is that the mercury-free HPS lamps are direct replacements to standard HPS lamps, saving time and money in retrofit applications.

Still another advantage of the present invention is that mercury, a toxic substance according to the United States EPA's TCLP guidelines, is eliminated from the HPS lamp.

DETAILED DESCRIPTION OF THE PREFERRED EMBODIMENT

Figure 1:
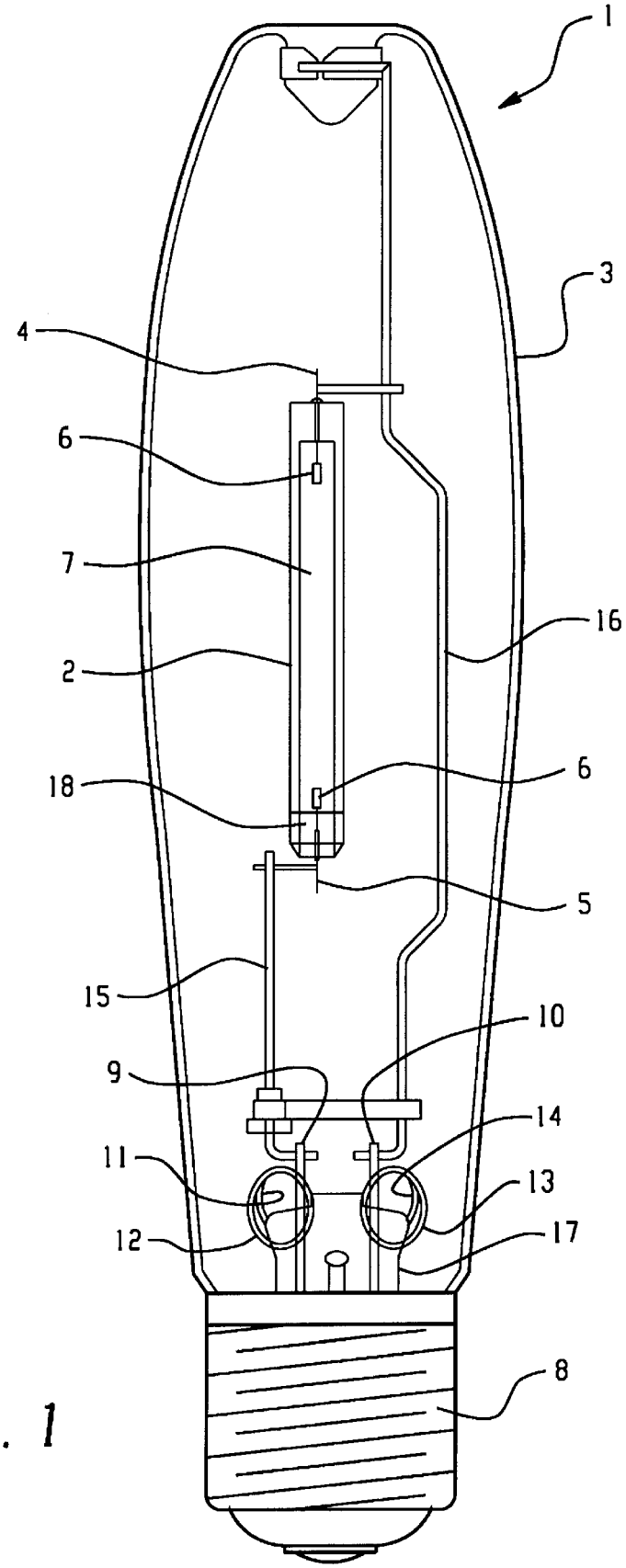
FIG. 1 is an elevational view in section of a mercury-free high pressure sodium discharge lamp of the present invention.

Referring now to the drawings, which illustrate a preferred embodiment of the invention only and are not intended to limit same, FIG. 1 shows a mercury-free high pressure sodium lamp 1, which includes a high pressure alumina discharge vapor arc chamber or arc tube 2 disposed within a transparent outer vitreous envelope 3. Arc tube 2 contains under pressure the arc-producing medium comprising sodium, elemental zinc, and preferably xenon as a starting gas. The xenon fill gas has a cold fill pressure from about 10 to 500 torr, preferably about 200 torr. During operation, the xenon pressure increases to about 8 times the cold fill pressure. The partial pressure of the sodium ranges from 30 to 1000 torr during operation, preferably about 70 to 150 torr for high efficacy. Electrical niobium lead wires 4 and 5 allow coupling of electrical energy to tungsten electrodes 6, containing electron emissive material, and disposed within the discharge chamber 2 so as to enable excitation of the fill 7 contained therein. Sealing frit bonds the lead wires 4 and 5 to the alumina of the arc chamber 2 at either end. Sealing is first done at lead wire 4. Sealing at lead wire 5 is accomplished using an alumina bushing feedthrough assembly. Lead wires 4 and 5 are electrically connected to the threaded screw base 8 by means of support members 15 and 16, and inlead wires 9 and 10, which extend through stem 17.

Initiation of an arc discharge between electrodes 6 requires a starting voltage pulse of 2 to 4 kilo volts. This ionizes the starting gas, initiating current flow which raises the temperature in arc tube 2 and vaporizes the sodium and zinc contained therein. Arc discharge is then sustained by the ionized vapor and the operating voltage stabilizes.

The lamp 1 also includes a niobium foil heat-reflective band 18, which maintains a higher operation of temperature at the end of arc chamber 2 toward the lamp base as compared to the opposite end. As a result, the unvaporized amounts of metallic dose components, i.e., sodium and zinc, reside at the colder end of arc chamber 2 during operation. The lamp 1 is designed to prohibit contact of liquid sodium with the sealing frit to avoid life-limiting reactions and the possibility of rectification (high ballast current) during start-up.

In the present invention, fill 7 contained within the outer envelope 3 consists of sodium and a starting gas, preferably xenon. The metallic dose (at the monolithic alumina corner) is introduced in conjunction with the xenon starting gas. Other acceptable starting gases would include any non-reactive ionizable gas such as a noble gas sufficient to cause the establishment of a gaseous arc discharge.

Traditionally, mercury has been used in the fill to increase the voltage of the lamp 1, thereby reducing lamp current. But, in view of established EPA TCLP guidelines limiting mercury content in solid waste and disposal costs for HPS lamps which contain mercury, the fill 7 is mercury-free, necessarily resulting in low-voltage operation at end-of-life. In accordance with the present invention, the use of an additional dosing element or additive in the sodium-xenon discharge eliminates the unwanted low-voltage effect at end-of-life. The additive element is selected based upon certain design criteria: it must have a lower excitation potential than the starting gas (the excitation potential of xenon being 8.4 electron volts); and a higher excitation potential than sodium (the excitation potential of sodium being 2.1 electron volts). Also, it must have sufficient vapor pressure during lamp operation so that when the sodium is lost, the additive becomes the primary radiator and maintains the end-of-life voltage of the HPS lamp within certain predetermined limits. For example, limits established by ANSI/IEC trapezoidal diagrams range from about 85% to about 150% of the rated nominal lamp voltage. By the terminology "rated nominal lamp voltage" it is meant a rating for the voltage of the lamp published by a recognized standardization body, e.g., International Electrotechnical Commission (IEC), American National Standards Institute (ANSI), and Japanese Industrial Standards (JIS).

The additive is preferably elemental zinc. Zinc's excitation potential of 4.0 electron volts lies between those of sodium (2.1 eV) and xenon (8.4 eV), so that when sodium is present, the spectrum is dominated by sodium radiation, with high luminous efficacy. Zinc is also chemically compatible with the typical materials of the arc tube (e.g., niobium, tungsten, alumina, sealing frit, and emission materials).

If the amount by weight of the elemental zinc additive is set below a certain value, then the zinc vapor pressure is said to be unsaturated. When the zinc vapor pressure is unsaturated, the zinc pressure during operation depends primarily on geometrical parameters which determine the volume of the arc tube and the quantity of zinc. For zinc doses above this critical value, the zinc vapor pressure is substantially independent of the arc tube volume or the dosed quantity of zinc, and accordingly, the zinc vapor pressure depends primarily on the temperature of the arc tube coldest spot. In a preferred embodiment, both zinc and sodium are dosed in a sufficient quantity to produce saturated vapor during operation, because performance is then dependent upon fewer manufacturing variables.

The design objective is to build arc tubes with at least a minimum amount of dosed zinc to maintain the saturated vapor mode (i.e., both a liquid phase and a vapor phase) during operation. This saturated vapor mode ensures that the zinc vapor pressure is independent of the quantity of zinc dosed and the arc tube volume.

To estimate dosing requirements for zinc in a just-saturated vapor condition, TABLE I below was prepared using the following data, calculations and assumptions:

- Use of values for the arc tube inner diameter (or bore, B) and arc gap, G, as known by those skilled in the art.
- An increase to about 727° C. (1000 Kelvin) of the cold spot temperature (about 700° C. when sodium is present) when the sodium is gone, due to higher arc temperature of the Metal—Xe discharge.
- Vapor pressures at 727° C. (1000 Kelvin) from tables set out in "Vapor Pressure of the Chemical Elements", by A N Nesmeyanov (1963).
- Calculation of average gas temperature between the electrode using formula (2*To+Tw)/3, where To is the core temperature of the M-Xe discharge, and Tw is the wall temperature. This relationship is easily shown if a parabolic radial temperature profile is assumed.
- Assumption that To=5500 Kelvin, characteristic of a mercury arc, according to "Light Sources" by W. Elenbaas (1972) (approximately 1200 Kelvin higher than the axis temperature of an Na—Xe discharge).
- Assumption that Tw=1623 Kelvin (approximately 200 Kelvin higher than the typical mercury-free wall temperature when Na is present (based on previous known measurements with pure Hg in HPS arc tubes)).
- Ignore effect of axial variation of the average gas temperature between electrode tips, since the aspect ratio G/B>15 for mercury-free designs.
- Estimation of electrode backspace to be 1 cm at each end. Ignore effect of electrode volume. Estimation of average gas temperature in the backspace regions to be 925° C.

Using the ideal gas law, moles of metal, i.e., zinc, in the backspace regions and between the electrode tips for each product were calculated and are set out in the results in Table I as N1 and N2, respectively. Total vapor phase Zn atoms were converted to micrograms, for each wattage. As shown in Table I, the quantity of Zn in the electrode backspace region is about one-third to one half of the total dosed.

Table I shows that required micrograms of zinc vary from about 18 micrograms for the 50 W lamp to about 81 micrograms for the 400 W lamp, for the just-saturated vapor condition. The minimum amount of dosed zinc, then, was determined to be about 10 to 100 micrograms per arc tube, depending upon the wattage of the lamp. Any additional zinc content within the arc tube will not affect the arc voltage or spectrum.

Similar calculations known to those skilled in the art for the just-saturated vapor condition for sodium showed that at least about 10 to 100 micrograms of sodium per arc tube, depending upon the wattage, are required for high efficacy.

TABLE I

| Lamp | Bore (B) (cm) | Gap (G) (cm) | Zn torr Psat @ 727° C. | Zn N1 Moles in Gap | Zn N2 Moles in ends | Zn Moles Total | Zn Atomic Weight | Zn (grams) | Zn (micrograms) |
|---|---|---|---|---|---|---|---|---|---|
| 50 W | 0.32 | 5 | 76 | 1.16E−07 | 1.64E−07 | 2.8E−07 | 65.4 | 1.83E−05 | 18.3 |
| 70 W | 0.33 | 5.6 | 76 | 1.39E−07 | 1.74E−07 | 3.13E−07 | 65.4 | 2.04E−05 | 20.4 |
| 100 W | 0.33 | 6.3 | 76 | 1.56E−07 | 1.74E−07 | 3.3E−07 | 65.4 | 2.16E−05 | 21.6 |
| 150 W | 0.37 | 7 | 76 | 2.18E−07 | 2.19E−07 | 4.36E−07 | 65.4 | 2.85−05 | 28.5 |
| 250 W | 0.45 | 8.5 | 76 | 3.91E−07 | 3.23E−07 | 7.15E−07 | 65.4 | 4.67E−05 | 46.7 |
| 400 W | 0.55 | 11 | 76 | 7.56E−07 | 4.83E−07 | 1.24E−06 | 65.4 | 8.1E−05 | 81.0 |

The invention will now be described in detail in the following examples.

EXAMPLE 1

A mercury-free HPS lamp was constructed for a 150 W reference ballast, having 4.0 mm bore, 7.9 cm arc gap, and charged with 1.9 milligrams of sodium and a xenon cold fill pressure of 275 millibar (209 torr). The lamp was burned for 100 hours to stabilize the electrical and photometric properties. Volts, efficiency (lumens/watt) and color rendering index (Ra) for the lamp were determined using methods well-known to those skilled in the art and are recorded in Table II.

EXAMPLE 2

Example 1 was repeated in an identical manner. Volts, efficiency (lumens/watt) and color rendering index (Ra) for the lamp are recorded in Table II.

EXAMPLE 3

Example 1 was repeated in an identical manner with the exception that the lamp was also charged with a 1 milligram dose of zinc. Volts, efficiency (lumens/watt) and color rendering index (Ra) for the lamp are recorded in Table II.

EXAMPLE 4

Example 3 was repeated in an identical manner. Volts, efficiency (lumens/watt) and color rendering index (Ra) for the lamp are recorded in Table II.

EXAMPLE 5

A mercury-free HPS lamp was constructed for a 150 W reference ballast having a 4.0 mm bore, 7.9 cm arc gap, and charged with 1 mg zinc and a xenon cold fill pressure of 275 millibar (209 torr). The lamp was burned for 100 hours to stabilize the electrical and photometric properties. The average operating voltage was measured as 112 volts.

EXAMPLE 6

Mercury-free HPS lamps were constructed for a 150 W reference ballast having a 4.5 mm bore, 7.0 cm arc gap, and charged with either 5 mg or 1 mg zinc, and a xenon cold fill pressure of 350 mbar (266 torr). After 100 hours stabilization, the average operating voltage of the lamps was measured as 88 volts.

EXAMPLE 7

A mercury-free HPS lamp was constructed for a 150 W reference ballast having a 4.0 mm bore, 7.9 cm arc gap, and charged with a xenon cold fill pressure of 275 millibar (209 torr). The lamp was burned for 100 hours to stabilize the electrical and photometric properties. The average operating voltage was measured as 64 volts.

EXAMPLE 8

A mercury-free HPS lamp was constructed for a 150 W reference ballast having a 4.5 mm bore, 7.0 cm arc gap, and charged with a xenon cold fill pressure of 350 mbar (266 torr). After 100 hours stabilization, the average operating voltage was determined to be 52.5 volts.

EXAMPLE 9

A mercury-free HPS lamp was constructed for a 150 W reference ballast having 4.0 mm bore, 7.9 cm arc gap, and charged with 1 milligram zinc and xenon cold fill pressure of 275 millibar (209 torr). The lamp was burned for 100 hours to stabilize the electrical and photometric properties.

EXAMPLE 10

Example 8 was repeated in an identical manner with the exception that the lamp was also charged with a 1 milligram dose of zinc. Efficiency (lumens/watt) was determined to be 5.7.

TABLE II

| Lamp | Volts | Lumens/Watt | Color Rendering Index (Ra) |
|---|---|---|---|
| Example 1 | 109 | 108.1 | 30.2 |
| Example 2 | 108 | 108.5 | 29.2 |
| Example 3 | 116 | 109.7 | 29.1 |
| Example 4 | 121 | 108.2 | 31.1 |

Figure 2:
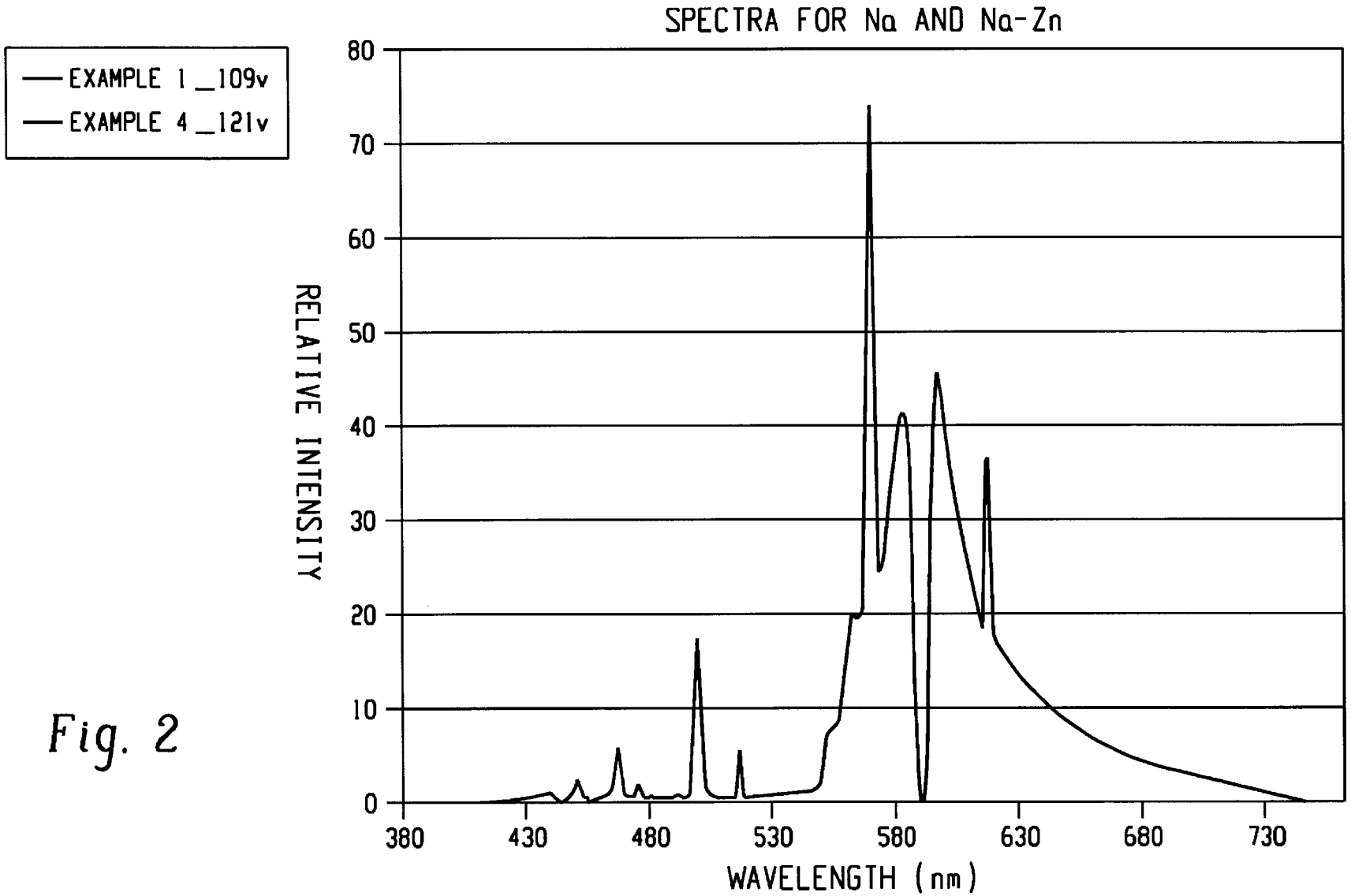
FIG. 2 is a graph illustrating the visible spectra of the Na—Xe and Na—Zn—Xe lamps constructed and tested in accordance with Examples 1 and 4.

FIG. 2 illustrates the visible spectra of selected Na—Xe and Na—Zn—Xe lamps from Examples 1 and 4, respectively, the visible spectrum generally being defined as the wavelength range between 380–760 nm. As illustrated in FIG. 2, the visible spectra of the selected lamps appear to overlap completely. Visible radiation is primarily from the sodium.

Figure 3:
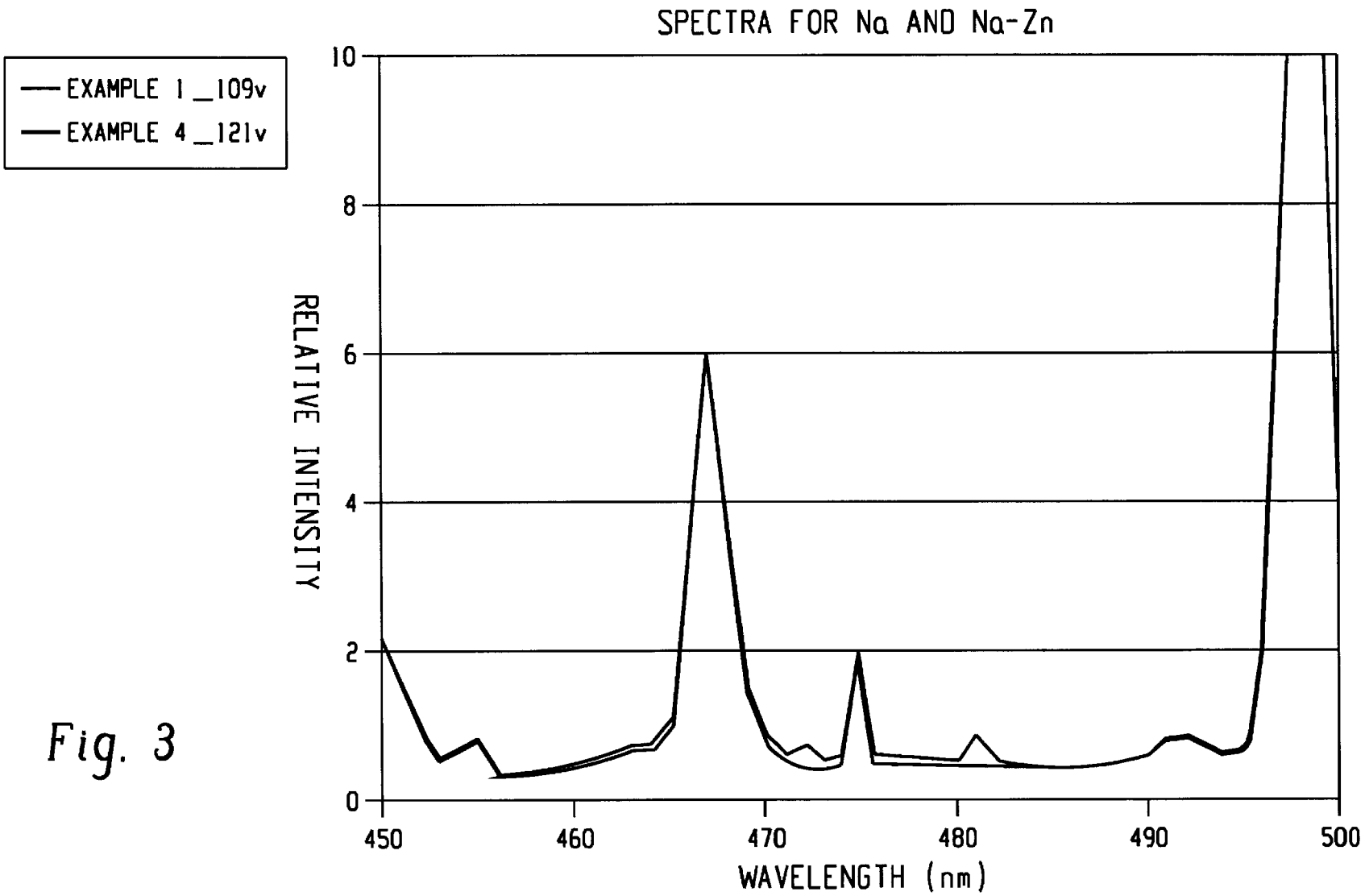
FIG. 3 is a graph illustrating the visible spectra of FIG. 2 magnified 8 times in the blue-green region between 450 and 500 nanometers.

At the higher magnification demonstrated in FIG. 3, a very small contribution from blue 472 and 481 nm zinc lines can be seen. When sodium is present, zinc hardly radiates because of the large difference in excitation potentials, i.e., 4.03 eV for zinc versus 2.1 eV for sodium.

Figure 4:
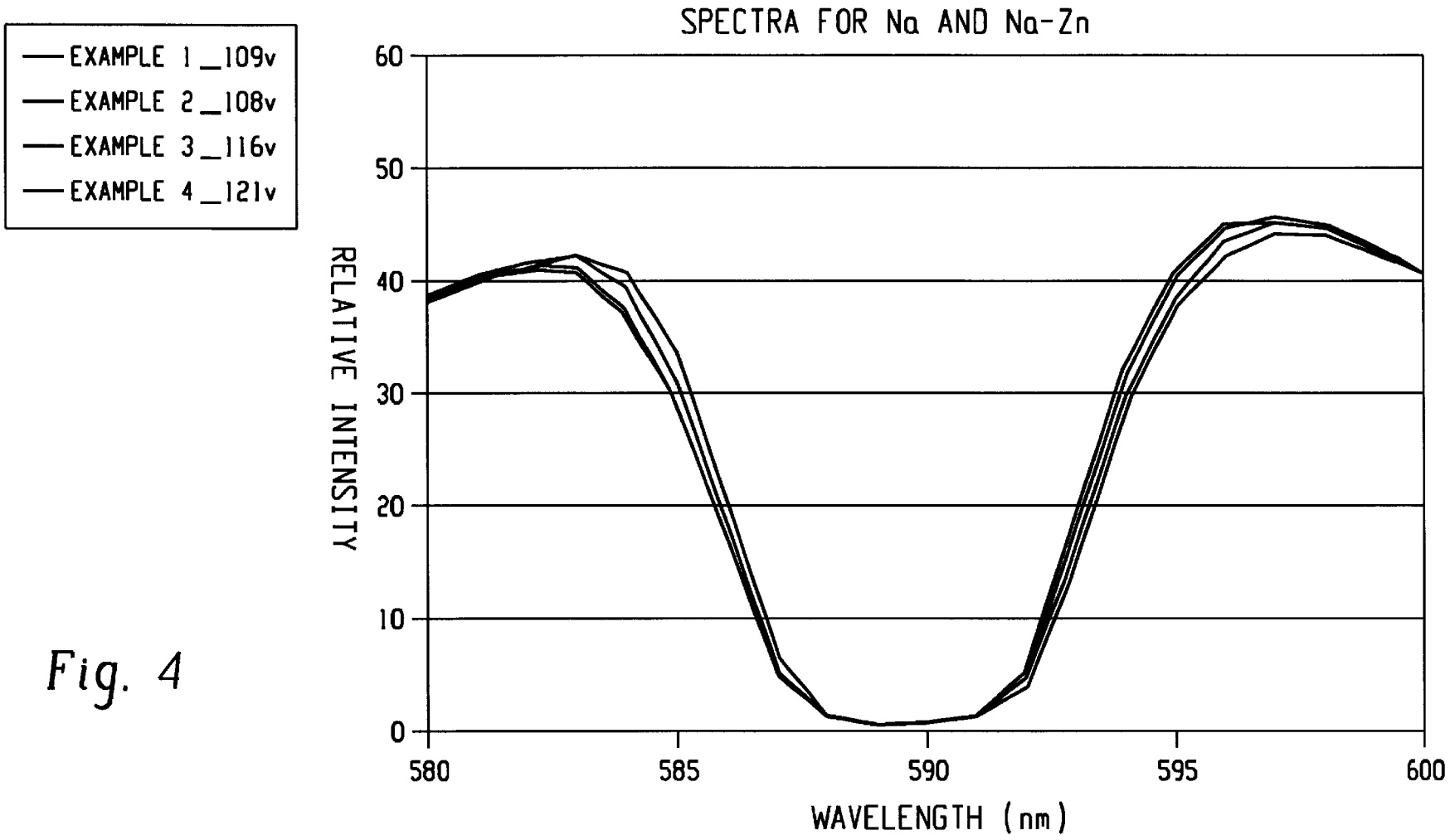
FIG. 4 is a graph illustrating the orange spectral region between 580 and 600 nanometers for the Na—Xe and Na—Zn—Xe lamps constructed and tested in accordance with Examples 1–4.

The self-reversal width of the sodium D-lines at 589 nm is a well-known measure of the sodium partial pressure during operation. This spectral region was essentially the same width for each of the lamps tested in Examples 1–4 and is illustrated in FIG. 4. The Color Rendering Index, Ra, another common measure of the sodium pressure, was also virtually the same for the four lamps set out in Examples 1–4.

Despite "spectral equivalence", the Na—Zn—Xe lamps were 10.5 volts higher than the Na—Xe lamps, on average, as shown in Table II. Zinc therefore appears to behave as a buffer gas, contributing to the lamp voltage—but not the light output—analogous to mercury in standard Na—Hg—Xe HPS lamps. From Table II, it can be determined that zinc's contribution to the arc electric field is approximately 11%.

Figure 5:
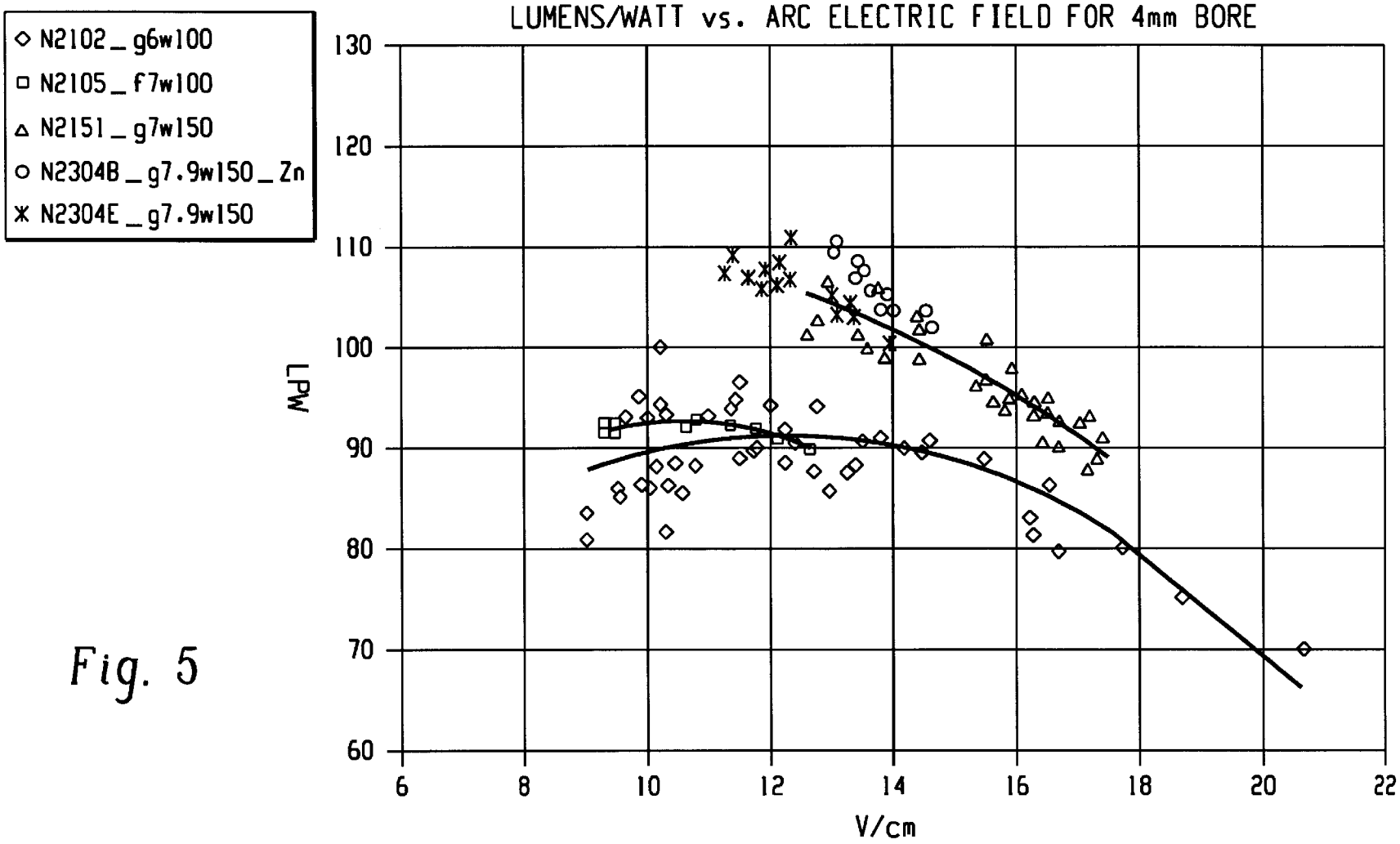
FIG. 5 is a graph illustrating a plot of luminous efficacy versus arc electric field for various Na—Xe and Na—Zn—Xe lamps having a 4.0 mm bore.
Figure 6:
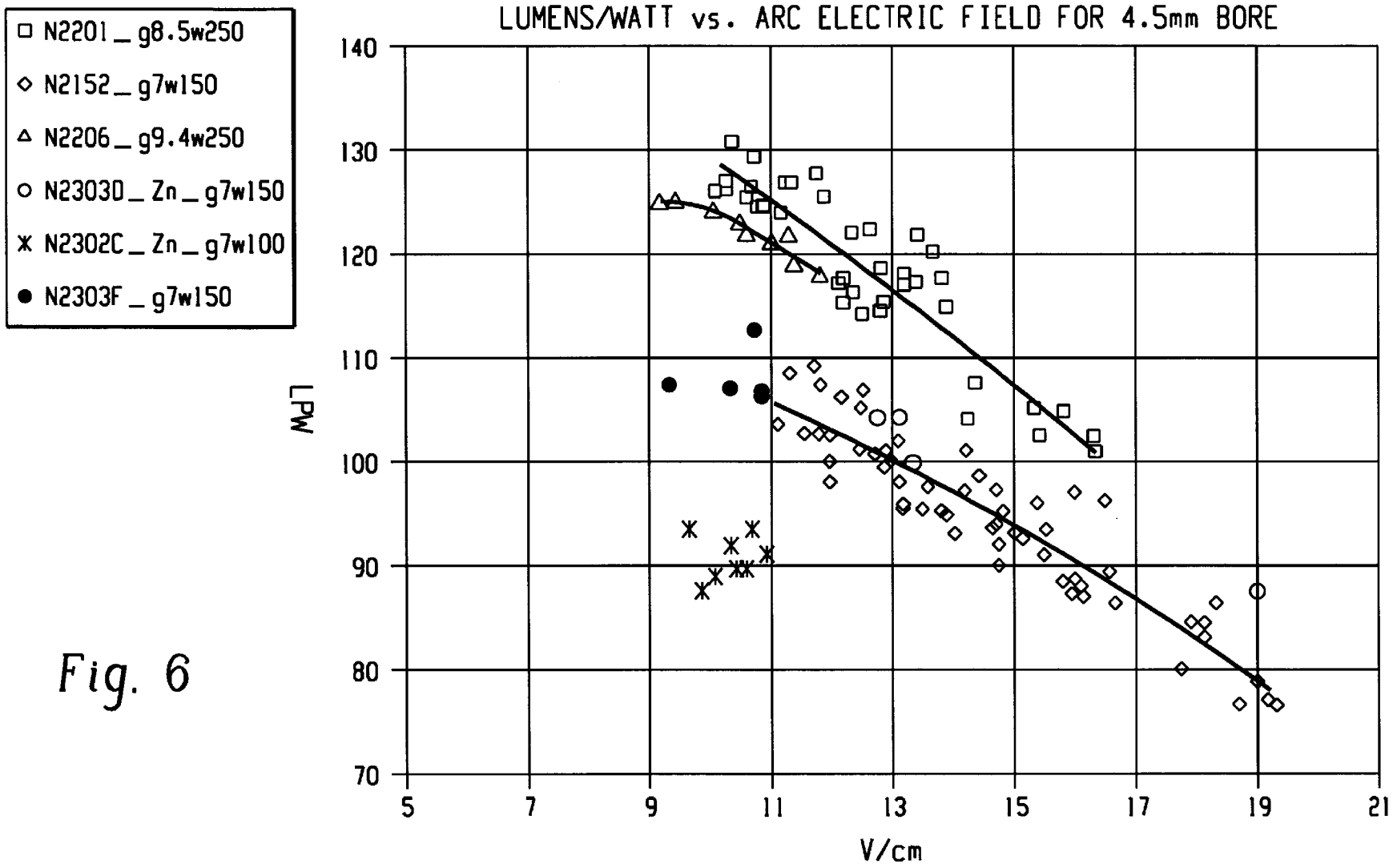
FIG. 6 is a graph illustrating a plot of luminous efficacy versus arc electric field for various Na—Xe and Na—Zn—Xe lamps having a 4.5 mm bore.

To estimate the value of the electric field where efficacy is optimum ($E_0$), the luminous efficacy versus the arc electric field for several Na—Xe and Na—Zn—Xe lamps subjected to the same testing as the Na—Xe and Na—Zn—Xe lamps shown in Examples 1 through 4 were plotted in FIGS. 5 and 6 for lamps having a 4.0 mm bore and a 4.5 mm bore. The formula used to calculate the electric field was E=(V-12)/G, where V is the lamp voltage, G is the arc gap, and an electrode end fall of 12 volts was assumed. Data series of lamps in FIGS. 4 and 5 are labeled by "test number, _arc gap in cm and reference ballast wattage", and also according to whether the Na—Xe lamp also contained zinc. From that information, one skilled in the art can readily see the design features corresponding to each lamp tested. In line with Examples 1–4, the zinc dosed was 1 milligram, where applicable. The charge for each lamp tested in FIGS. 5 and 6 also included from two to five milligrams of sodium, an amount well in excess of the critical amount needed to obtain for saturated vapor, and xenon at 275 millibar average pressure.

The graphs of FIGS. 5 and 6 illustrate that higher efficacy is achieved at a higher power per unit arc gap, and that an optimum value of E for luminous efficacy exists with a numerical value which depends upon the bore size. These effects are well known in HPS technology. From FIGS. 5 and 6 it may be concluded that the same efficacy is achievable if zinc is added to the sodium-zenon mix. The Na—Zn—Xe data are just shifted to the right by about 11% as a result of the buffer gas effect.

Table III sets out, in part, the $E_0$ value estimated from FIGS. 5 and 6 for a Na—Xe lamp. $E_0$ for an Na—Xe lamp having a 4.0 mm bore was determined from FIG. 5 to be 11 V/cm by estimating the peak of the parabola shown therein. For a 4.5 mm bore Na—Xe lamp, $E_o$ was determined by estimating the peak of the parabola plotted in FIG. 6.

The $E_o$ value for the corresponding Na—Zn—Xe lamps was estimated from Table II to be 11% greater than the value shown for the Na—Xe lamps in Column 1, of Table III. Thus, the $E_o$ values for the Na—Zn—Xe lamps in Table III are estimated to be 11% greater than those for the Na—Xe lamps.

TABLE III

| Bore | Eo_Na—Xe V/cm | Eo_Na—Zn—Xe V/cm | E_Zn—Xe V/cm | E_Xe V/cm |
|---|---|---|---|---|
| 4.0 mm | 11 | 12.2 | 12.6 | 6.6 |
| 4.5 mm | 9.5 | 10.6 | 10.9 | 5.8 |

The E values in Table III for the Zn—Xe dosed lamps were calculated from the voltage values measured in Examples 5 and 6. The E values for the xenon-dosed lamps were calculated from the voltage values measured in Examples 7 and 8.

Using the experimental values of $E_0$ and E set out in Table III, it is possible to illustrate zinc's success at eliminating an undesirable end-of-life failure mode for a mercury-free HPS arc tube.

EXAMPLE 11

For a 150 W MF lamp to be designed in 4.0 mm bore, with an IEC prescribed arc length of 7 cm, and design center voltage of 100 volts, the optimum efficacy in the Na—Xe design space occurs at (11*7+12)=89 volts. But in order to center the design at 100 volts, the Na coldspot temperature must be further increased so that $E>E_0$. The operating point moves to the right of optimum with perhaps 1–2penalty in efficacy. With Na—Zn—Xe dosing, optimum efficacy occurs essentially at the design center voltage or (12.2*7+12)=98 volts. Further, at end-of-life, when the sodium is lost, the lamp voltage is (12.6 * 7+12)=100 volts. Lamp voltage for the Na—Zn—Xe dosing is remarkably constant over life. On the other hand, without zinc, lamp voltage could drop to that for Xenon—that is, (6.6*7+12)=58 volts—well below the IEC minimum of 85 volts. Such a drop results in ballast overheating.

EXAMPLE 12

For a 250W lamp to be designed in 4.5 mm bore, with an IEC prescribed arc length of 8.5 cm, and design center voltage of 100 volts, the optimum efficacy in the Na—Xe design space occurs at (9.5*8.5+12)=93 volts. But in order to center the design at 100 volts, the Na coldspot temperature must be further increased so that $E>E_0$. The operating point moves to the right of optimum, again with perhaps 1–2% lumen penalty. With Na—Zn—Xe dosing, optimum efficacy occurs very near the design center voltage or (10.6*8.5+12)=102 volts. Further, at end-of-life, when the sodium is lost, the lamp voltage is (10.9*8.5+12)=105 volts, again, remarkably constant and well within specification. On the other hand, without zinc, lamp voltage could drop to that for xenon—that is, (5.8*8.5+12)=61 volts, well below the IEC minimum of 85 volts. Such a drop results in ballast overheating.

Figure 7:
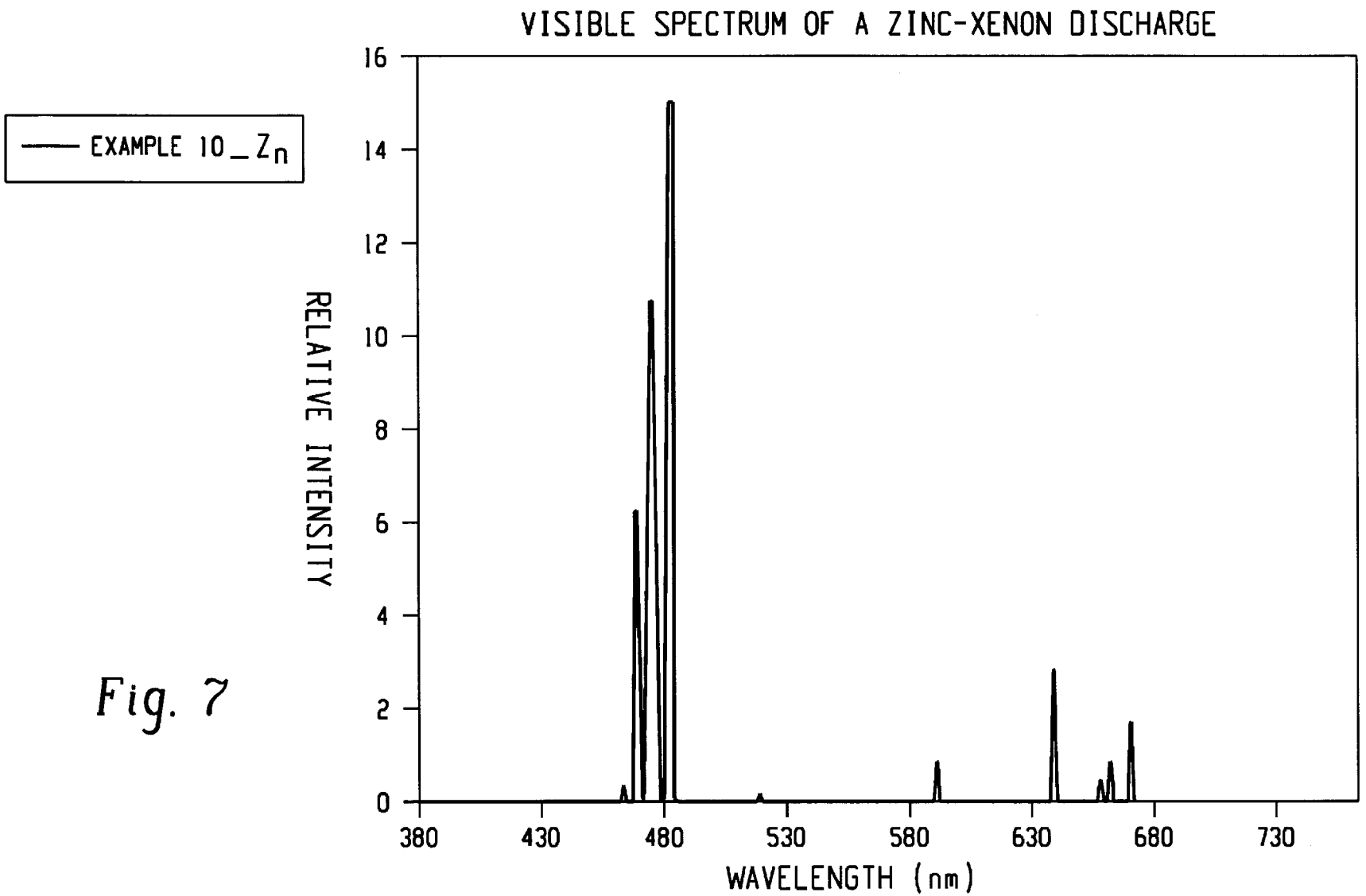
FIG. 7 is a graph illustrating the visible spectrum of a zinc-xenon lamp constructed and tested in accordance with Example 9.

Aside from the prevention of the undesirable low voltage operating mode corresponding to the sodium-xeon discharge, another advantage of using zinc is that the resultant zinc-xenon discharge has a distinctly different color when compared to the initial sodium-zinc-xenon dosed lamp. For example, compare FIG. 7, showing only several prominent blue lines and several weaker red lines in the visible spectrum, of a zinc-xenon discharge, with the initial sodium spectrum of FIG. 2. Further, as is best demonstrated using the results of Example 10, an efficacy of the zinc-xenon discharge of 5.7 lumens/watt was measured—about 5% of the original value measured in Examples 3 and 4. In this regard, the change from golden-white to a typical reddish-blue color and lower luminous efficacy can become the primary indication, at the end-of-life phase of the lamp, that the lamp must be replaced.

The invention has been described with reference to the preferred embodiment. Obviously, modifications and alterations will occur to others upon the reading and understanding of this specification. For example, other dosing elements, aside from those referenced herein, may be utilized in the discharge as long as certain design parameters are met. The invention is intended to include all such modifications and alterations insofar as they come within the scope of the appended claims or the equivalents thereof.

What is claimed is:

1. A mercury-free high pressure sodium vapor discharge lamp comprising:

a vessel having a discharge space formed therein;

end members hermetically sealing the vessel;

electric leads extending through the end members; and electrodes disposed at the ends of the electric leads extending through the end members;

the discharge space comprising sodium, a starting gas, and elemental zinc, the zinc present in an amount sufficient to become a primary radiator and maintain voltage in a range from about 85% to about 150% of a rated nominal voltage at an end-of-life operation mode of the lamp when the sodium is lost.

2. The lamp of claim 1 wherein the sodium develops a partial pressure in a range of 30 to 1000 torr during operation of the lamp and the noble gas has a cold fill pressure in a range of 10 to 500 torr.

3. The lamp of claim 2 wherein the noble gas is xenon.

4. The lamp of claim 1 wherein the zinc is present in an amount sufficient to produce saturated zinc vapor pressure at an end-of-life operation mode of the lamp.

5. The lamp of claim 1 wherein the zinc is dosed in an amount ranging from 10 to 100 micrograms.

6. The lamp of claim 1 wherein the sodium is present in an amount sufficient to produce saturated sodium vapor pressure during operation of the lamp.

7. A mercury-free high pressure sodium vapor lamp comprising an arc discharge tube containing a fill comprising sodium, a noble gas, and an elemental zinc additive, the sodium developing a partial pressure in a range of 30 to 1000 torr during operation of the lamp, the noble gas having a cold fill pressure in the range of 10 to 500 torr.

8. The lamp of claim 7 wherein the noble gas is xenon.

9. The lamp of claim 7 wherein the zinc is present in an amount sufficient to produce saturated zinc vapor pressure at an end-of-life operation mode of the lamp.

10. The lamp of claim 7 wherein the zinc is dosed in the fill in an amount ranging from 10 to 100 micrograms.

11. The lamp of claim 7 wherein the sodium is dosed in the fill in an amount ranging from 10 to 100 micrograms.

12. The lamp of claim 7 wherein the sodium is present in an amount sufficient to produce saturated sodium vapor pressure during operation of the lamp.

13. A combination of metals for producing the operative vapor in a mercury-free high pressure sodium vapor lamp, the combination comprising sodium and zinc, the zinc present in an amount sufficient to produce saturated zinc vapor pressure at an end-of-life operation mode of the lamp when the sodium is lost.

14. The combination of claim 13 wherein the sodium is present in an amount sufficient to produce saturated sodium vapor pressure during operation of the lamp.

15. The combination of claim 13 wherein the zinc is dosed in an amount ranging from 10 to 100 micrograms.

16. The combination of claim 13 wherein the sodium is dosed in an amount ranging from 10 to 100 micrograms.

* * * * *